US006683570B2

(12) United States Patent
Skladany et al.

(10) Patent No.: US 6,683,570 B2
(45) Date of Patent: Jan. 27, 2004

(54) COMPACT MULTI-BAND ANTENNA

(75) Inventors: James Matthew Skladany, Somersworth, NH (US); Thomas S. Laubner, Merrimac, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/966,235

(22) Filed: Sep. 28, 2001

(65) Prior Publication Data

US 2002/0180643 A1 Dec. 5, 2002

Related U.S. Application Data

(60) Provisional application No. 60/279,614, filed on Mar. 29, 2001.

(51) Int. Cl.[7] ..... H01Q 1/36

(52) U.S. Cl. ..... 343/700 MS; 343/752; 343/872; 343/725

(58) Field of Search ..... 343/752, 830, 343/872, 725, 846, 853, 893, 700 MS; H01Q 5/00, 1/36

(56) References Cited

U.S. PATENT DOCUMENTS 5,539,418 A * 7/1996 Egashira et al. ..... 343/830
6,023,245 A * 2/2000 Gomez et al. ..... 343/725
6,188,366 B1 * 2/2001 Yamamoto et al. ..... 343/752

OTHER PUBLICATIONS

International Search Report, International application No. PCT/US 02/09806, International filing date, Mar. 27, 2002.

* cited by examiner

*Primary Examiner*—Michael C. Wimer

(57) ABSTRACT

The invention is a multi-band antenna in which two, three or more antennas are contained within a single housing/radome. Two top-loaded monopole antennas are nested together with one of the antennas being positioned between the ground plate and top plate of the other antenna. Inductive shunts for counteracting the capacitance in the two top-loaded monopole antennas can be provided by hollow conductive tubes in order to help the antenna more closely emulate a purely resistive 50 ohm impedance. A third, microstrip antenna may be positioned on top of the top conductive plate of the outer top-loaded monopole antenna. The cable for the microstrip antenna is routed through the ground plate and top plate of at least one of the top-loaded antennas and through the inside of one of the hollow inductive shunts.

13 Claims, 2 Drawing Sheets

COMPACT MULTI-BAND ANTENNA

RELATED APPLICATION

This application is based on U.S. Provisional Application No. 60/279,614 filed Mar. 29, 2001 entitled "Automotive Tri-Band Antenna for AMPS/PCS/GPS", the disclosure of which is incorporated herein by reference.

FIELD OF THE INVENTION

The invention relates to antennas. More particularly, the invention pertains to compact, multi-band antennas.

BACKGROUND OF THE INVENTION

As more and more wireless or radio frequency (RF) services become available to the general public, the need for compact antennas increases. The size and configuration of antennas typically is not of great concern for stationary applications, but becomes a significant issue in connection with mobile applications. For instance, it is not uncommon now for an automobile to have multiple built-in wireless/RF devices, including, but not limited to, a cellular telephone, a global positioning satellite (GPS) system for navigational purposes, and a digital satellite radio/audio system. Most modern cellular telephones are themselves tri-mode telephones capable of transmitting and receiving in three distinct bands, namely, an analog band which operates in a band of 824–896 MHz, a digital band in accordance with the American Mobile Phone System (AMPS) protocol which operates in a band of 806–896 MHz, and a second digital band in accordance with the Personal Communication Systems (PCS) protocol which operates in a band of 1850–1990 MHz.

In monopole antenna design, an antenna mast typically extends perpendicularly from a ground plane (or ground plate). In accordance with international standards, the antenna should present a purely resistive 50 ohm impedance at its input terminal in the frequency band in which it is intended to receive and/or transmit. This can be accomplished by providing an antenna mast of a length that has good resonance at the frequency of the signals it is to receive and/or transmit. In simple monopole antenna designs, a mast that is approximately equal in length to one quarter wavelength of the signals it is to transmit and/or receive has good resonance and provides a very good input match to 50 ohms.

However, it is often impractical or even impossible to provide an antenna mast having a length equal to one quarter of a wavelength. At a minimum, it is almost always desirable to reduce the size of all electronics related components, including antennas and particularly antenna masts, especially in mobile (e.g., cars) or hand-held (e.g., cellular telephone, wireless personal digital assistant) applications.

It is well known to "top load" monopole antennas in order to reduce the required length of the mast. Particularly, if a second conductive plate is placed at the distal end of the antenna mast generally perpendicular to the ground plane, resonance can be achieved with a much shorter antenna mast. Particularly, top loading a monopole antenna introduces a capacitance between the top plate and the ground plane that, in accordance with well known antenna theory, substantially reduces the required length of the antenna mast (the spacing between the top plate and the ground plane) needed to achieve resonance for a particular frequency of electromagnetic wave. Despite the capacitance between the ground plate and the top plate, the device still reasonably emulates a 50 ohm impedance.

Another common type of antenna is known as a microstrip antenna. A microstrip antenna commonly comprises a sheet of material with good microwave properties and appropriate thickness and having copper cladding on both sides. The sheet may take any number of shapes but is usually a square having a size that is determined as a function of the wavelength of interest. A portion of the copper cladding on one side is usually etched away to a predetermined size. Microstrip antennas radiate from their edges and are very compact. However, they typically have very narrow effective bandwidths and thus typically are suitable only for use with receivers, transmitters and/or transceivers that operate over a very narrow bandwidth. GPS would be a good example of a protocol in which microstrip antennas can be used effectively since the bandwidth for GPS transmissions is very narrow.

It also is common for microstrip antennas to be sold as an integral unit with a printed circuit board having active circuitry thereon. Particularly, the microstrip antenna may be attached on the top side of a printed circuit board, for instance, by double sided adhesive tape, with active circuitry disposed on the bottom side of the printed circuit board. The bottom of the printed circuit board is then covered with an enclosure, commonly called a "can", in order to protect the circuitry.

It is an object of the present invention to provide an improved multi-band antenna assembly.

It is another object of the present invention to provide a multi-band antenna assembly that is compact.

It is a further object of the present invention to provide an efficient multi-band antenna with high gain.

SUMMARY OF THE INVENTION

The invention is a multi-band antenna in which two, three or more antennas are contained within a single housing/radome. In accordance with a first aspect of the invention, two top-loaded monopole antennas are nested together with one of the antennas being positioned between the ground plate and top plate of the other antenna. Inductive shunts for counteracting the capacitance in the two top-loaded monopole antennas can be provided by hollow conductive tubes in order to help the antenna more closely emulate a purely resistive 50 ohm impedance. In accordance with another aspect of the invention, a third, microstrip antenna may be positioned on top of the top conductive plate of the outer top-loaded monopole antenna. The cable for the microstrip antenna is routed through the ground plate and top plate of at least one of the top-loaded antennas and through the inside of one of the hollow inductive shunts.

DETAILED DESCRIPTION OF THE INVENTION

Figure 1:
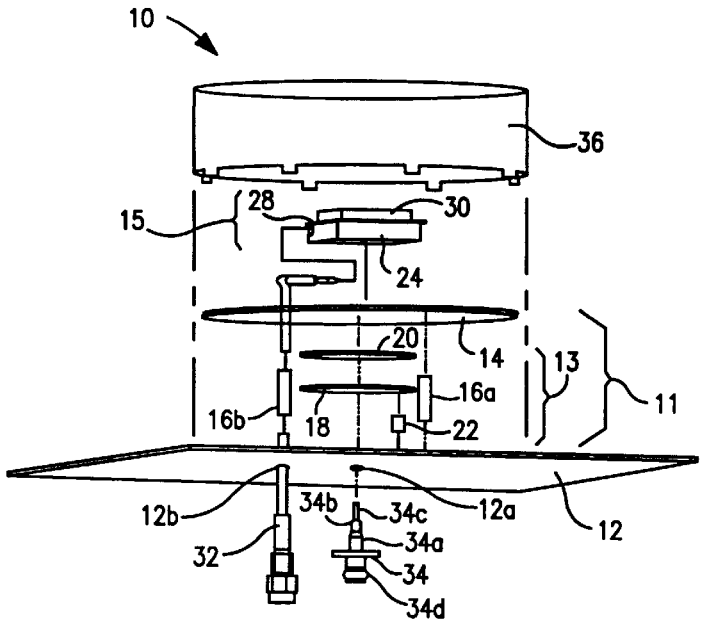
FIG. 1 is an exploded perspective view of a multi-band antenna in accordance with one embodiment of the present invention.
Figure 2:
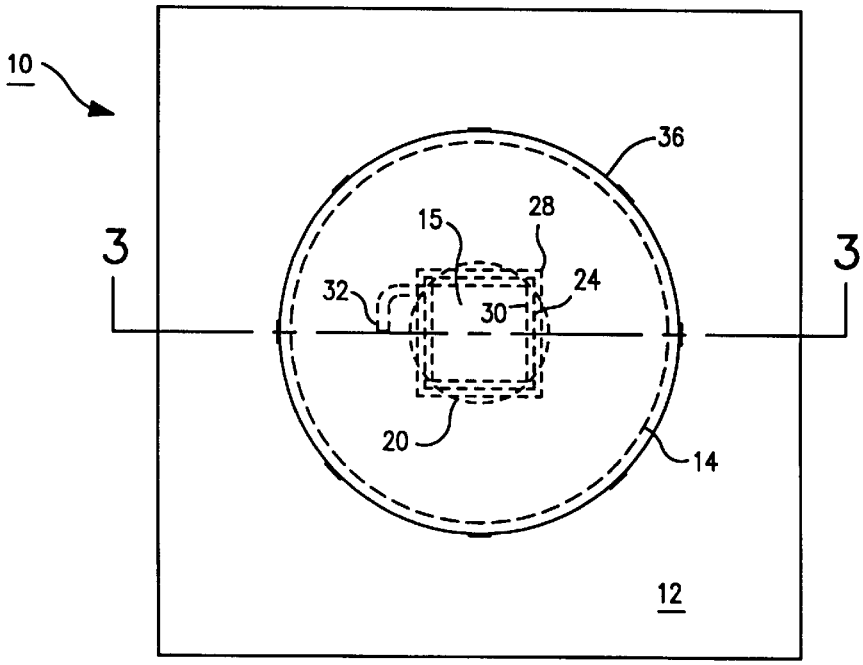
FIG. 2 is a plan view of a multi-band antenna at FIG. 1.
Figure 3:
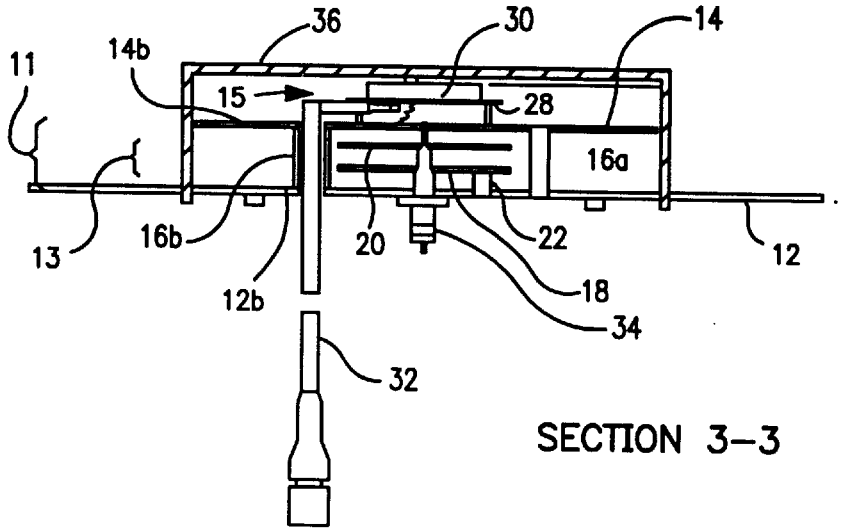
FIG. 3 is a cut-away elevation view of the multi-band antenna of FIGS. 1 and 2 taken along line A—A of FIG. 2.
Figure 4:
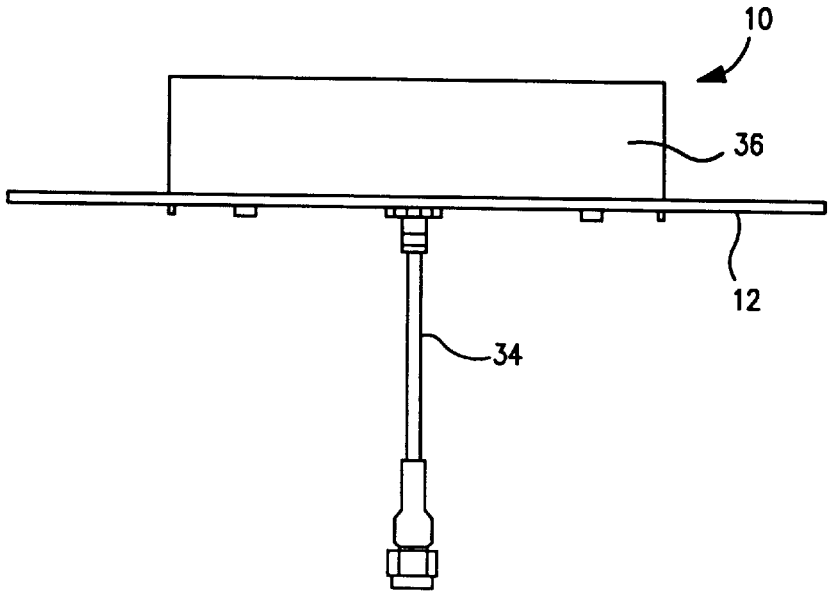
FIG. 4 is a side view of the antenna of FIGS. 1–3.

FIGS. 1 through 4 illustrate a multi-band antenna in accordance with one particular embodiment of the invention in which three antennas are integrated in a single package. In this embodiment, the three antennas are a top-loaded monopole AMPS antenna 11 designed to transmit and receive signals in the AMPS bandwidth of 806–896 MHZ, a top-loaded monopole PCS antenna 13 designed to transmit and receive in the PCS bandwidth of 1850–1990 MHZ and a microstrip GPS 15 antenna designed to transmit and receive in the GPS bandwidth of 1575 MHZ. However, it should be understood by those of skill in the art that the invention is applicable to antennas for receiving and transmitting in virtually any two or more frequency bands.

Plate 12 is the ground plane for the AMPS antenna. Ground plane 12 is a conductive plate of substantial size and may be provided as an integral part of the antenna. However, in other embodiments, ground plane 12 may actually comprise a portion of the apparatus on which the antenna is mounted. For instance, in a vehicular application, ground plane 12 may comprise a portion of the vehicle such as the roof or rear package tray. The rear package tray is the horizontal shelf at the rear end of the passenger compartment of a typical sedan or coupe automobile under which the rear speakers for the audio system are typically mounted. The antenna may be mounted to the bottom side of the rear package tray and use the metal frame of the tray as the ground plane 12. The AMPS antenna further comprises a top conductive plate 14 to provide a capacitance between the ground plane 12 and the top plate 14 so that the mast 34 can be made shorter than one quarter wavelength, as well known in the art. The mast of the antenna is provided by a coaxial cable 34. The coaxial cable 34 includes a connector 34*d* adapted to connect to another coaxial cable that leads to one or more transmitters, receivers or transceivers that are to receive and/or transmit signals via the antenna assembly 10. Coaxial cable 34 comprises an outer conductor 34*a*, an inner conductor 34*c* coaxial with and running through the middle of the outer conductor 34*a* and a dielectric insulating layer 34*b* therebetween. The outer coaxial conductor 34*a* electrically contacts the ground plane 12 while the inner conductive layer 34*c* electrically contacts the top plate 14. Accordingly, the electromagnetic signals received by the antenna (or sent to the antenna for transmission) travel along the coaxial cable as a field between the outer and inner conductors 34*a* and 34*c* as is well known in the antenna art.

Outer conductor 34*a* runs through a hole 12*a* in the ground plane 12 and terminates at plate 18 (which is the ground plane of a second antenna, as will be described further below). The outer conductor 34*a* is soldered to the ground plane 12 and plate 18. The dielectric insulating layer 34*b* runs through the middle of outer conductor 34*a* and terminates at the bottom side of plate 20 (also to be described further below in connection with the aforementioned, second antenna). Accordingly, inner conductor 34*c* does not make electrical contact with either ground plane 12 or plate 18, but does electrically contact top plate 14 of the AMPS antenna as well as plate 20 (to be described further below). The inner conductor 34*c* is soldered to plate 20 and the upper plate 14 of the AMPS antenna.

AMPS antenna 11 further comprises a pair of inductive shunts 16*a* and 16*b*. Structurally, items 16*a* and 16*b* are hollow conductive tubes running vertically between ground plane 12 and top plate 14 of the AMPS antenna 11. The shunts 16*a* and 16*b* are conductively connected at their opposite ends to the ground plane 12 and the conductive plate 14, respectively. Conductive shunts 16*a* and 16*b* may be formed entirely of conductive material such as copper or may be formed of a nonconductive material bearing a conductive plating. In addition, the conductive posts 16*a* and 16*b* serve as physical support for the upper plate 14 over the ground plane 12.

The effective circuit of the AMPS antenna in accordance with this design is a resistance in parallel with a capacitance and further in parallel with an inductance. The capacitor formed of ground plane 12 and top plate 14 and the inductor formed of parts 16*a* and 16*b* comprise an LC parallel circuit. The size and shape of the inductive shunts 16*a* and 16*b*, should be selected such that the reactances of the inductor and capacitor are equal and opposite so as to cancel or counteract each other as closely as possible so that the input of the device appears as a purely resistive 50 olm impedance. In fact, that is the definition of resonance.

For example, the effective capacitance of a top loaded monopole antenna is given by:

$$C = \epsilon \frac{A}{d},$$

where

C=capacitance,

ϵ=dielectric constant of the material between the plates (typically air),

A=the area of the top plate 14 projected onto the ground plane (which would be the total area of the top plate, if it is parallel to the ground plane), and d=the distance between the top plate and the ground plane.

This equation assumes that the ground plane is infinite.

The desired capacitance between the top plate 14 and the ground plane 12 will be selected primarily as a function of the desired mast length. Then, the inductive post 16*a* and 16*b* can be sized and shaped as a function of the selected capacitance in order to counteract as closely as possible the capacitance at the resonance frequency of the circuit. The effective inductance of the post is given by the equation:

$$L = 2l\left(\log_n\left(\frac{2l}{r}\right) - 1\right),$$

where

L=inductance, l=the length of the post, and r=the outer radius of the post.

Nested within the AMPS antenna 11 and particularly between the ground plane 12 and top plate 14 of AMPS antenna 12 is a second top loaded, monopole antenna 13. Antenna 13 is a PCS antenna. Particularly, plate 18 essentially is the ground plane and plate 20 is the top plate of the PCS antenna. PCS antenna 13 uses the same coaxial cable 34 for its mast as AMPS antenna 11. Particularly, as previously noted, the outer conductive layer 34*a* of the coaxial cable mast contacts both ground plane 12 of the AMPS antenna 11 as well as the bottom plate 18 of the PCS antenna 13. Likewise, inner conductor 34*c* contacts the top plate 14 of the AMPS antenna 11 as well as the top plate 20 of the PCS antenna 13. Accordingly, both the PCS signals and the AMPS signals travel along the same pair of conductors 34*a* and 34*c* to their respective transceivers. Accordingly, PCS antenna 13 uses a length portion of mast 34 equal to the distance between plates 18 and 20 as it's mast while AMPS antenna 11 uses a length portion of mast 34 equal to the distance between plates 12 and 14 as it's mast. The signals can be routed to and from connector 34*d* to both a PCS transceiver and an AMPS transceiver, where filters can isolate the pertinent frequencies for each transceiver, respectively.

PCS antenna 11 also includes another inductive shunt 22 similar in design to shunts 16*a* and 16*b* for counteracting the capacitance between plates 18 and 20. Particularly, inductive shunt 22 comprises a hollow conductive tube. The tube may be made entirely of a conductive material, such as copper, or may be a plastic coated with a layer of conductive material.

It has been found through experiment that, unlike the situation for the AMPS antenna 11, inductive shunt 22 works best when positioned between ground plate 18 of the PCS antenna 13 and the ground plane 12 of the AMPS antenna 11, rather than between plates 18 and 20 of the PCS antenna 11.

Because the PCS frequency band (1850–1990 MHz) is much higher than the AMPS bandwidth (806–896 MHz), plates 18 and 20 can be smaller than top plate 14 and ground plane 12 of the AMPS antenna 11 and the distance between the two plates 18 and 20 of PCS antenna 13 also is shorter than the distance between ground plane 12 and top plate 14 of AMPS antenna 11. Accordingly, PCS antenna 13 easily fits entirely nested within the AMPS antenna 11.

In accordance with another aspect of the invention, a third antenna 15, this one a microstrip antenna such as can be used for GPS, is disposed on top plate 14 of the AMPS antenna. The GPS antenna 15 is essentially a conventional GPS antenna in that it comprises a microstrip portion 30 mounted on a printed circuit board 28. The bottom of the printed circuit board may have active circuitry for processing the GPS signals received by the microstrip antenna and, in at least one embodiment, includes a low noise amplifier and a bandpass filter (not shown). The circuitry is encapsulated within a can 24. The bottom surface of the can 24 may be attached to the top surface of the plate 14 by double sided adhesive tape.

Signals received by the microstrip antenna 15 are carried to a GPS receiver via a second coaxial cable 32. In a preferred embodiment of the invention, coaxial cable 32 runs through hole 12*b* in the ground plane 12 and hole 14*a* in top plate 14 to mate with a connector 28 on the GPS antenna 15.

The entire antenna assembly 10, excluding the ground plane 12, is enclosed within a radome 36. The radome 36 can be made of any material, such as a plastic having suitable microwave properties. Suitable microwave properties generally include having a dielectric constant of between 1 and 5 and a loss tangent between 0.01 and 0.001.

By nesting the smaller, PCS antenna within the larger AMPS antenna, two monopole top-loaded antennas can be made to fit within the volume previously required for just one of the antennas. Further, the required volume for the multi-band antenna is further minimized by running the cable for the GPS microstrip antenna through one of the inductive shunts 16*a*, 16*b*.

Even further, the use of the inductive shunts to cancel the effective capacitance of the two top-loaded monopole antennas 11, 13 increases the efficiency of the antennas by canceling the effective capacitance of the antennas thus allowing the antennas to more closely emulate a purely resistive 50 ohm impedance at their input and/or output terminals.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A multi-band antenna assembly comprising:

a first top loaded, monopole antenna comprising at least a first ground plate and a first top plate axially displaced from each other, a first conductor electrically connected to said first ground plate, and a second conductor electrically connected to said first top plate; and a second top loaded, monopole antenna comprising a second conductive ground plate and a second top plate axially positioned between said first ground plate and said first top plate of said first top loaded antenna, wherein said first conductor is electrically connected to said second ground plate, and said second conductor is electrically connected to said second top plate.

2. The multi-band antenna assembly of claim 1 further comprising a microstrip antenna positioned on top of said first top loaded antenna.

3. The multi-band antenna assembly of claim 2 further comprising a radome enclosing said first top loaded antenna, said second top loaded antenna and said microstrip antenna.

4. The multi-band antenna assembly of claim 3 wherein said radome mates with said first ground plate of said first top loaded antenna to encapsulate said second top loaded antenna, said microstrip antenna and at least a portion of said first top loaded antenna.

5. The multi-band antenna assembly of claim 1 wherein said first top loaded antenna further comprises a first inductive shunt.

6. The multi-band antenna assembly of claim 5 wherein said first inductive shunt comprises at least one conductive post connecting said first ground plate to said first top plate.

7. The multi-band antenna assembly of claim 6 wherein said conductive post comprises two conductive posts.

8. The multi-band antenna assembly of claim 6 wherein said second top loaded antenna further comprises a second inductive shunt.

9. The multi-band antenna assembly of claim 8 wherein said second inductive shunt comprises a conductive post connecting said second ground plate to said first ground plate.

10. The multi-band antenna assembly of claim 6 wherein said post is hollow and wherein said multi-band antenna further comprises:

a microstrip antenna positioned on top of said first top load antenna; and a cable for coupling signals to or from said microstrip antenna; and wherein said cable runs through said conductive post.

11. The multi-band antenna assembly of claim 9 wherein said first conductor axially surrounds said second conductor.

12. The multi-band antenna assembly of claim 11 wherein said first and second conductors comprise a coaxial cable.

13. The multi-band antenna assembly of claim 12 wherein said first and second ground plates, said first and second top plates and said coaxial cable are coaxial.

* * * * *